US006304222B1

(12) United States Patent
Smith et al.

(10) Patent No.: US 6,304,222 B1
(45) **Date of Patent: *Oct. 16, 2001**

(54) RADIO COMMUNICATIONS HANDSET ANTENNA ARRANGEMENTS

(75) Inventors: Martin Stevens Smith, Chelmsford; Ian Paul Llewellyn, Harlow; Sonya Amos, Old Harlow; Julius George Robson, Great Dunmow; Anthony Dalby, Hauxton; Peter Gwynn, Metheringham, all of (GB)

(73) Assignee: Nortel Networks Limited, St. Laurent (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/995,602

(22) Filed: Dec. 22, 1997

(51) Int. Cl.[7] ..... H01Q 1/24

(52) U.S. Cl. ..... 343/702; 343/700 MS; 343/873; 343/845

(58) Field of Search ..... 343/829, 845, 343/702, 700 MS, 873, 876; H01Q 1/24

(56) References Cited

U.S. PATENT DOCUMENTS

| | | | | |
|---|---|---|---|---|
| 4,021,810 | | 5/1977 | Urpo et al. | 243/731 |
| 4,679,233 | * | 7/1987 | Richardson et al. | 379/433 |
| 4,860,020 | | 8/1989 | Wong et al. | 343/828 |
| 4,958,382 | * | 9/1990 | Imanishi | 455/277 |
| 5,696,517 | * | 12/1997 | Kawahata et al. | 343/700 MS |
| 5,710,987 | * | 1/1998 | Paulick | 455/90 |
| 5,943,019 | * | 8/1999 | Kawahata et al. | 343/702 |

FOREIGN PATENT DOCUMENTS

| | | | |
|---|---|---|---|
| 0777293A1 | 6/1997 | (EP) | H01Q/1/36 |
| WO 93/12559 | 6/1993 | (WO) | H01Q/9/42 |
| WO 96/27219 | 9/1996 | (WO) | H01Q/9/24 |
| WO 96/38882 | 12/1996 | (WO) | H01Q/9/30 |

* cited by examiner

*Primary Examiner*—Don Wong
*Assistant Examiner*—Shih-Chao Chen
(74) *Attorney, Agent, or Firm*—Lee, Mann, Smith, McWilliam, Sweeney & Ohlson

(57) ABSTRACT

This invention relates to internal antenna arrangements for radio communications handsets. Internal antenna size and shape represents a constraint on handset miniaturisation if good antenna efficiency and bandwidth characteristics are to be maintained. The use of acoustic enhancing volumes of free space about a handset's speaker unit also constrains further miniaturisation. The present invention provides an internal antenna arrangement which facilities further miniaturisation and which combines antenna volume with the acoustic enhancing volume.

12 Claims, 7 Drawing Sheets

AZIMUTH PATTERN DUAL RESONANT ANTENNA AT 850 MHz

AZIMUTH PATTERN DUAL RESONANT ANTENNA AT 1920 MHz

RADIO COMMUNICATIONS HANDSET ANTENNA ARRANGEMENTS

FIELD OF THE INVENTION

The invention generally relates to radio communications handsets, and in particular to internal antenna arrangements.

PRIOR ART

Recent advances in mobile communications have been coupled with increasing demand for miniaturisation of mobile communications handsets. A significant limitation on such miniaturisation is the internal antenna size which cannot easily be reduced.

Existing antennas used in radio communications handsets include extendible monopoles, microstrip patch antennas, inverted L and F antennas, and helix antennas.

Half or quarter wavelength monopoles extend a significant length from the handset and have a number of disadvantages including the inconvenience of such a long protuberance which is easily broken and can be hazardous to users eyes for example.

The microstrip patch, while having a low profile, small size and light weight, has low efficiency or a narrow bandwidth.

The inverted L antenna requires a significant physical length (quarter wavelength) for efficient operation, this is generally not possible within a handset so that a shortened L is generally inefficient. This can be improved by using a tuning element in the form of a stub to the ground plane giving the antenna an inverted F configuration, however this still suffers from inefficiency and limited bandwidth in the physical size constraints applicable to a handset.

The helix antenna, while conveniently short, still requires a significant cylindrical volume which may be extended outside the main body of the handset forming a short protuberance. While this facilitates to some extent miniaturisation of the main handset, the protuberance is inconvenient in practical use. The helix also suffers from a narrow bandwidth.

Various meandering antenna arrangements are also known. U.S. Pat. No. 4021810 discloses a 3D array of meander structure conductors above a ground plane which is complex to produce and is susceptible to the vagaries of manufacturing tolerances. WO96/38882 discloses a printed meandering monopole antenna extending from a mobile handset. While the meandering monopole is shorter than a standard monopole, it still represents an inconvenient protuberance outside the handset. WO93/12559 discloses a planar metallic sheet inverted F antenna having dependant elements angled with respect to the planar structure. As such it is delicate and complicated to manufacture.

In addition to the above mentioned antenna size and volume constraints on the miniaturisation of handsets, there is now an increasing need for a handset to be used in different communications systems such as mobile and cordless telephony or mobiles in different countries, which requires the handset to be operable over more than one frequency band. While a single antenna and a multiple band matching circuit may be employed, this can prove overly complex and costly so that in practice each handset may require a separate antenna for each frequency band together with sufficient spacing between adjacent antennas to minimise coupling effects there between.

OBJECT OF THE INVENTION

It is an object of the present invention to facilitate handset miniaturisation by providing improved or alternative internal antenna arrangements for such handsets.

SUMMARY OF THE INVENTION

In accordance with a first aspect of the present invention, there is provided a radio communications handset comprising:

- a speaker having an adjacent volume of free space for acoustic enhancement;
- and an antenna arrangement which incorporates said volume within the antenna arrangement.

Preferably the antenna arrangement comprises a ground plane and a radiating element, said volume being located between said ground plane and said radiating element. Preferably the radiating element is spaced a non-uniform distance from said ground plane.

Preferably the antenna arrangement comprises

- a ground plane;
- a meandering radiating element extending in a series of opposing bends from a radio-frequency feed point and spaced a non-uniform distance from said ground plane;
- and wherein said volume is located between said ground plane and said radiating element.

The opposing bends may be effected in more than one plane.

Preferably the antenna arrangement further comprises a planar element connected to the free end of said monopole and extending back along and substantially parallel with said monopole.

The introduction of the planar element allows the second harmonic frequency of the antenna arrangement to be varied; effectively introducing a second controllable resonant frequency band within the single antenna structure.

Preferably the handset further comprises:

- an extendible external antenna;
- radio frequency transceiver means; and
- antenna switching means which is arranged to switch between said transceiver means and said external antenna or said antenna arrangement upon manual extension or retraction of said external antenna.

In accordance with a further aspect of the invention, there is provided a radio communications handset comprising an internal antenna arrangement adapted to accommodate one or more handset components, said antenna arrangement comprising:

- a ground plane;
- a meandering radiating element extending in a series of opposing bends from a radio-frequency feed point and spaced a non-uniform distance from said ground plane;
- wherein said handset component is located between said radiating element and said ground plane.

Preferably the handset component is an acoustic enhancing volume of free space located adjacent a loudspeaker. Alternatively or in addition the component may be another handset part such as an RF filter element located on the periphery of the volume.

In accordance with a further aspect of the invention, there is provided a radio communications handset internal antenna arrangement comprising:

a ground plane;

a meandering monopole extending in a series of opposing bends from a radio-frequency feed point and spaced a non-uniform distance from said ground plane.

The ground plane may be formed on the PCB, or an additional metallic plane may be formed perpendicular to the plane of the PCB which extends to a width corresponding to that containing the opposing bends of the meandering monopole.

Preferably the antenna arrangement further comprises a planar element connected to the free end of said monopole and extending back along and substantially parallel with said monopole.

The bends may be effected in more than one plane.

BRIEF DESCRIPTION OF THE DRAWINGS

In order that a greater understanding of the invention be obtained, embodiments of the invention will now be described with reference to the accompanying drawings, by way of example only and without intending to be limited, in which.

DETAILED DESCRIPTION

Figure 1A:
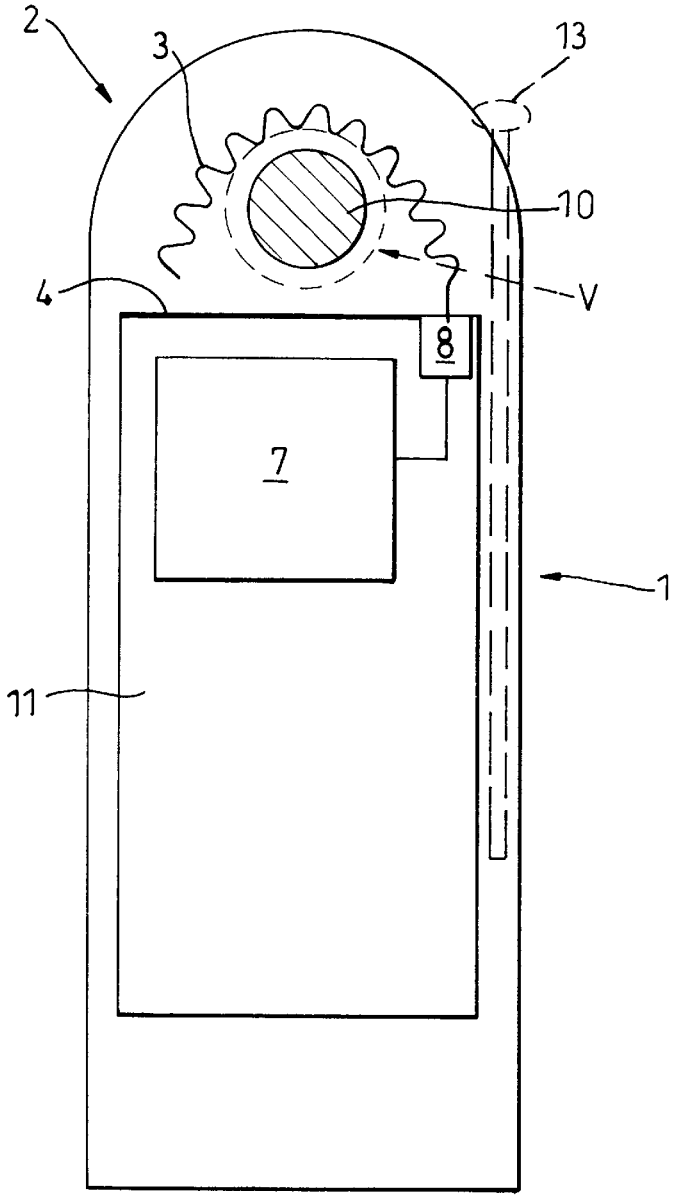
FIG. 1(*a*) shows a preferred embodiment handset arrangement of the invention, and FIG. 1(*b*) shows a detail section of the handset's acoustic volume contained within the handset's antenna arrangement.
Figure 1B:
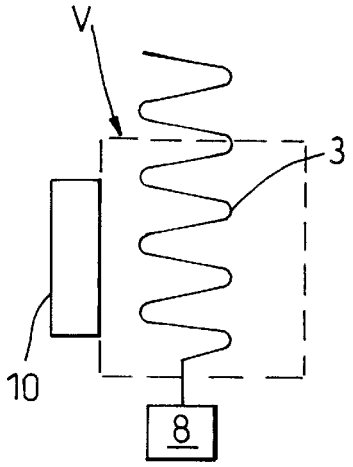

Referring to FIG. 1(*a*), a handset 1 of the invention is there shown comprising a speaker unit 10 and an adjacent volume of free space V extending behind the speaker unit (as shown in detail 1(*b*) ) for acoustic enhancement; an antenna arrangement 2 comprising a ground plane 4 and a radiating element 3 extending from a radio frequency feed point 8 on the handsets printed circuit board (PCB) 11.

The radiating element 3 is curved with respect to the ground plane 4 and is arranged to fit around the peripheral edges of the acoustic enhancing volume of free space V, thereby incorporating the volume V within the antenna arrangement 2.

The ground plane may be formed on the handset's PCB 11, or a metallic plane may be formed perpendicular to the PCB 11 for example by a shielding case.

The radiating element 3 of the antenna arrangement 2 is preferably a monopole type structure formed into a zig-zag pattern which consists of a series of opposing bends. The zigzag formation of the radiating element 3 maintains a small and convenient volume within the handset 1 while providing a self-resonant antenna 2 as described herein below. This particular antenna construction also provides good antenna efficiency and bandwidth characteristics.

It should be noted that unlike conventional short antennas for handset applications, such as inverted F and folded monopole antennas, the radiating element 3 of the present invention does not require tuning or matching stubs, nor grounding at any point along its length to achieve the desired resonant frequency from its compact dimensions. By contrast the radiating element of the invention is fed at one end while the other end is left free. This facilitates inclusion of handset elements such as speaker acoustic enhancing volumes between the radiating element 3 and the ground plane 4.

The inclusion of the acoustics volume V between the radiating element 3 and the ground plane 4 reduces the combined internal antenna and acoustic volumes on further miniaturisation of handsets with this acoustic volume V.

Figure 2A:
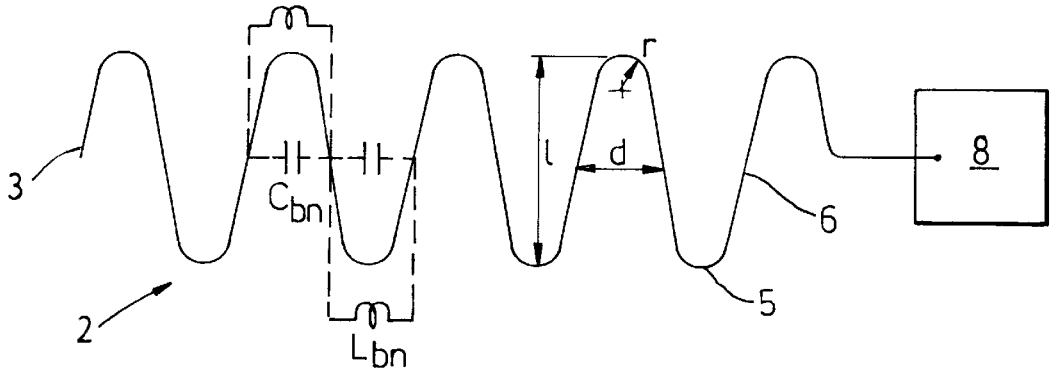
FIGS. 2(*a*) and (*b*) show in detail an preferred embodiment antenna arrangement of the invention in plan and elevation respectively.
Figure 2B:
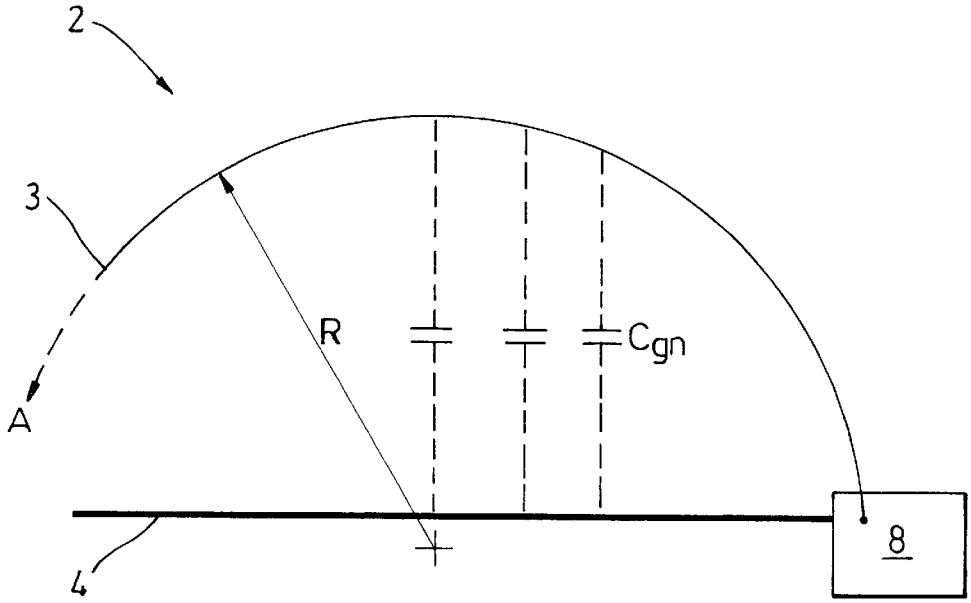

A preferred antenna arrangement of the invention is described in more detail with reference to FIGS. 2(*a*) and (*b*). The antenna arrangement 2 comprises a radiating element 3 and ground plane 4 connected to the handset's radio frequency transceiver circuitry 7 via a radio frequency feed point 8. The antenna 2 is shown in plan in FIG. 2*a* and in elevation in FIG. 2*b*. Referring to FIG. 2*a*, the radiating element 3 is a monopole structure which extends from the feed point 8 in a series of opposing bends which form a zigzag pattern of substantially parallel sections 6 separated by the bends 5. Referring to FIG. 2*b*, the radiating element 3 extends in a curve A with respect to the ground plane 4.

Each bend 5 introduces an inductive element $L_{bn}$ into the antenna 2 which increases with sharpness (reduced radius r) of the bend 5. Capacitive elements $C_{bn}$ are introduced between adjacent sections 6 which are dependent on the respective parallel lengths l and distances d between adjacent sections. Further capacitive elements $C_{gn}$ are introduced between the radiating element 3 and the ground plane 4, each notional capacitance $C_{gn}$ being dependent on the distance between the ground plane 4 and radiating element 3 at that point.

The combination of bends 5 and sections 6 can be thought of as a matching network composed of a variable inductor and capacitor in parallel, together with a shunt capacitor to ground. By varying the length l and separation distance d of the sections 6 the capacitance $C_b$ can be varied and by varying the bend 5 distance or radius r, the inductance $L_b$ can be varied. Similarly by varying the separation between the radiating element 3 and ground plane 4 and the radiating element radius R, the shunt capacitance $C_g$ can be varied.

By varying these capacitive and inductive elements experimentally the antenna 2 can be made self-resonant at a desired frequency. The antenna 2 of the invention therefore does not require a matching network for tuning.

The bandwidth of the antenna can be broadened by extending the total length of the radiating element 3. The capacitive elements $C_{gn}$ also influence the bandwidth of the tuned antenna 2.

The centre frequency of the antenna 2 is influenced by the capacitive elements $C_{gn}$ and $C_{bn}$ and the inductive elements $L_{bn}$. In practice these elements are varied experimentally to obtain the desired centre frequency and bandwidth of the antenna 2. The dimensions of the resulting antenna structure can then be mass produced as required.

Preferably the radiating element 3 consists of a piece of plated wire bent into a series of bends to cause inductance and capacitance along its length. The whole radiating element 3 sits above the ground plane 4 of a PCB 11 in the handset 1, forming a variable impedance transmission line as the distance between the ground plane 4 and radiating element 3 varies.

The series of bends 5 and sections 6 which form the radiating element 3 need not form a regular pattern as is shown in the preferred embodiment.

The zig-zag pattern of the bends 5 and sections 6 is formed in a plane colinear with the direction of extension of the radiating element—denoted by curve A in FIG. 2*b*. While this plane is shown in FIGS. 2*a* and 2*b* as perpendicular to the PCB 11 plane, the zig-zag pattern may be formed in any plane colinear with curve A. For example FIG. 1 shows the radiating element 3 formed in a plane parallel with the PCB 11 plane.

Figure 3A:
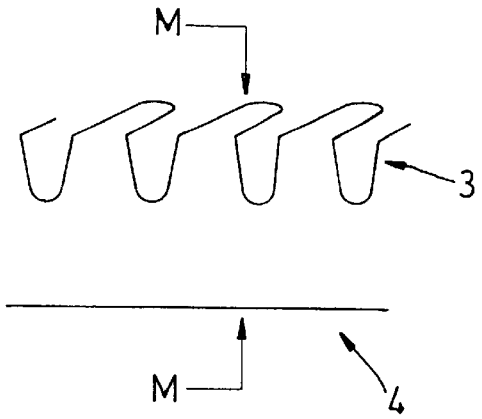
FIGS. 3(*a*) and (*b*) show an alternative embodiment antenna arrangement in perspective and section respectively.
Figure 3B:
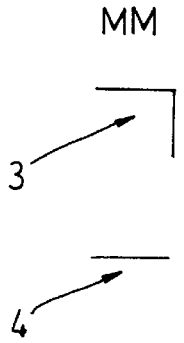

As a further alternative the radiating element zigzag pattern may be formed in more than one plane as is shown in FIG. 3 in which the pattern extends in two perpendicular planes—one parallel and one perpendicular to the PCB 11 plane.

Figure 4A:
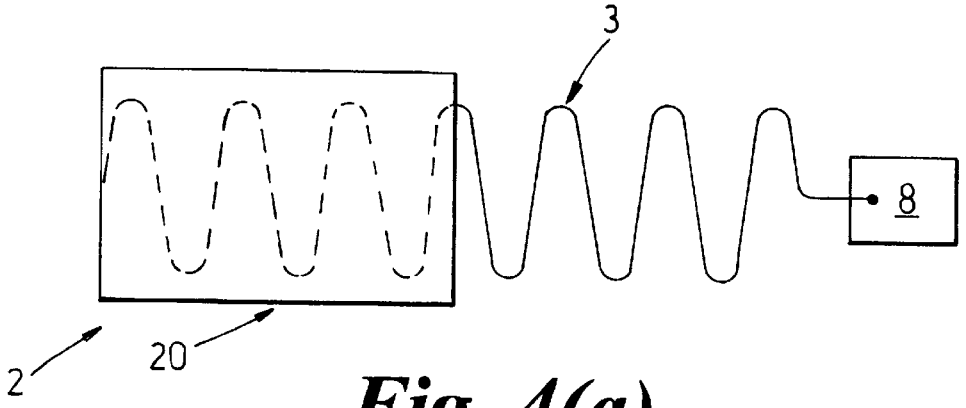
FIGS. 4(*a*) and (*b*) show a multi band embodiment of the antenna arrangement in plan and elevation respectively.
Figure 4B:
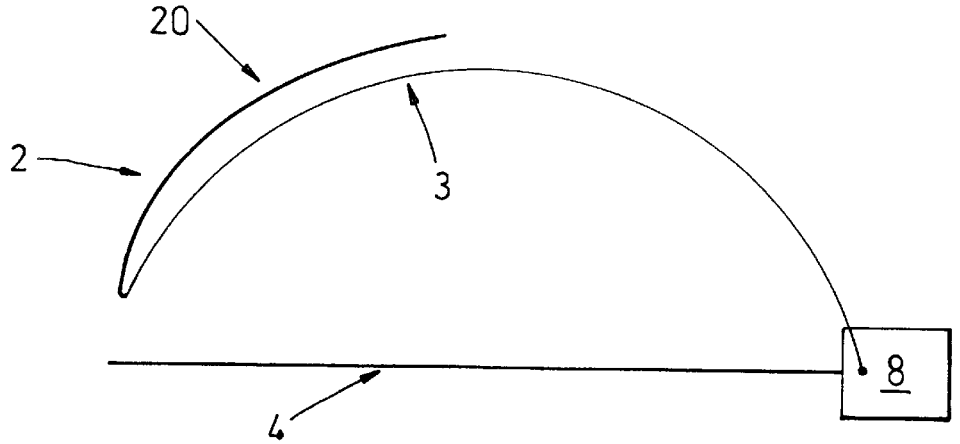

A further embodiment antenna 2 is shown in FIGS. 4(*a*) and (*b*) which comprises a dual band antenna 2 in which a plate or planar element 20 is connected to the free end of the radiating element 3 extending back from the connection and substantially parallel with the radiating element 3. The presence of the planar element 20 shifts the second harmonic of the fundamental resonant frequency of the antenna 2 along the frequency spectrum effectively introducing a further controllable frequency band. The planar element 20 shifts the second harmonic down the frequency spectrum depending on for example the planar elements length and distance from the radiating element 3. The dimensions of the planar element 20 and its physical relationship to the radiating element 3 are obtained experimentally for the desired frequency bands. FIG. 4 shows the dual band antenna tuned to the 850 MHz and 1920 MHz frequency bands. In experimentation, the first preferred embodiment antenna arrangement has been shown to have an antenna efficiency of 75% at 850 MHz. For the second preferred dual band antenna arrangement of FIG. 4, the antenna efficiency at 850 MHz has been measured at 75%, and at the higher band of 1920 MHz an antenna efficiency of 91% has been achieved. This compares favourably with an antenna efficiency of 71% for a helix antenna at 920 MHz.

Figure 5:
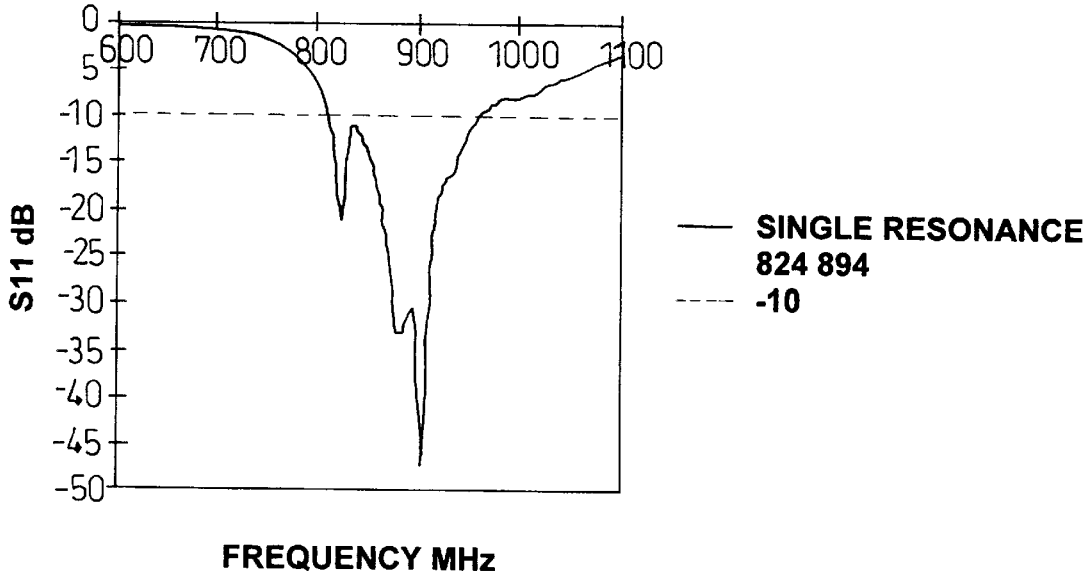
FIG. 5 shows insertion loss for a single band antenna.

FIG. 5 shows the insertion loss of the single frequency antenna. It can be seen that adequate return loss (>10 dB) is seen across the band, this can be improved by retuning. Placement of the intended speaker unit 10 inside the antenna 2 produced only a slight change in frequency which is readily retuned.

Figure 6:
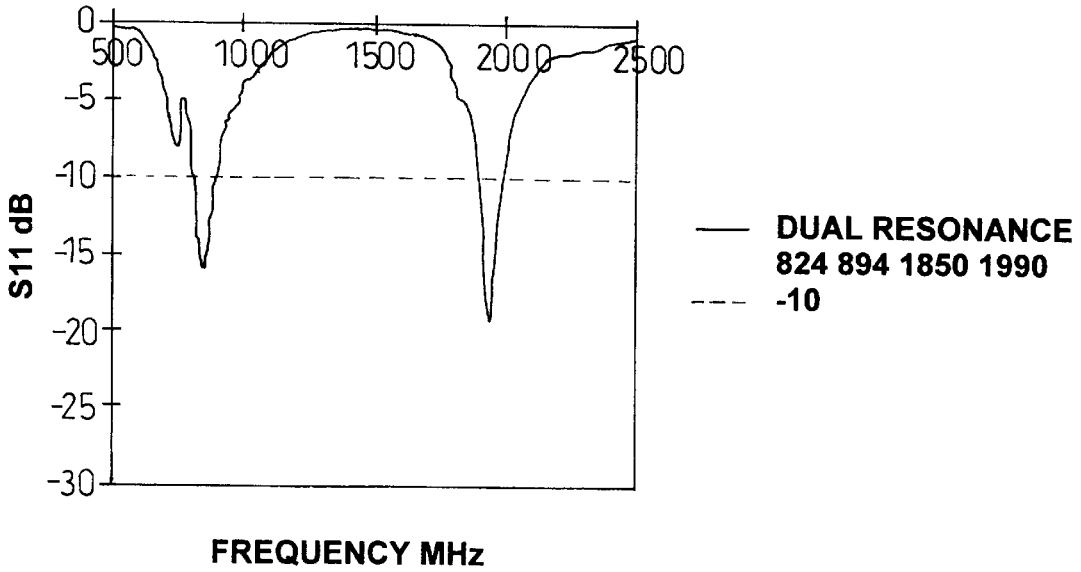
FIG. 6 shows insertion loss for a dual band antenna.
Figure 7:
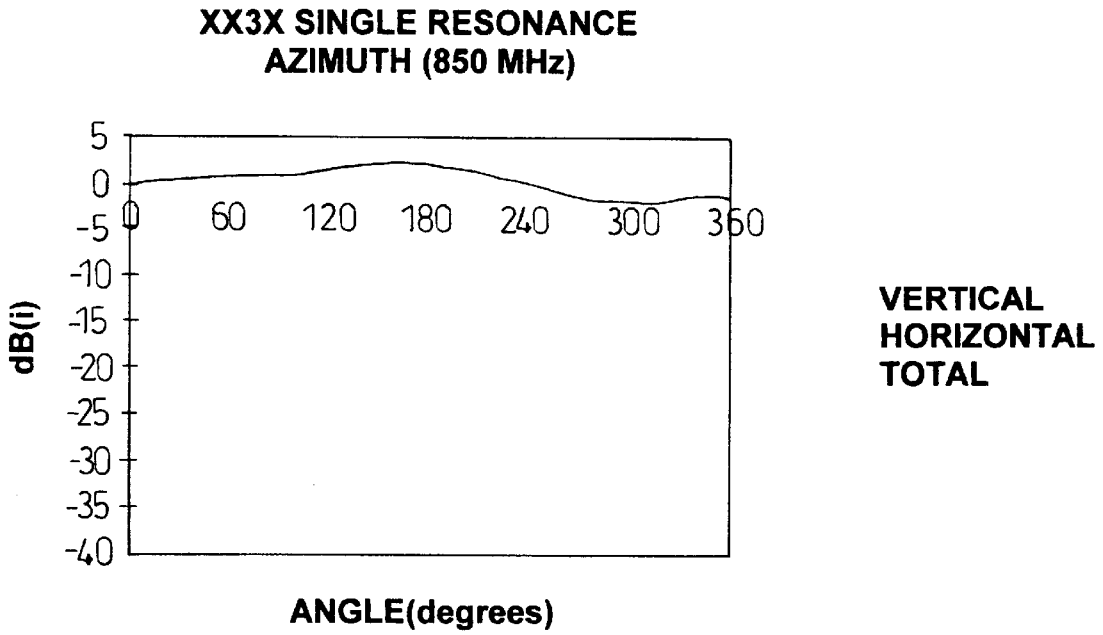
FIG. 7 shows the azimuth radiation pattern for the single band antenna.
Figure 8:
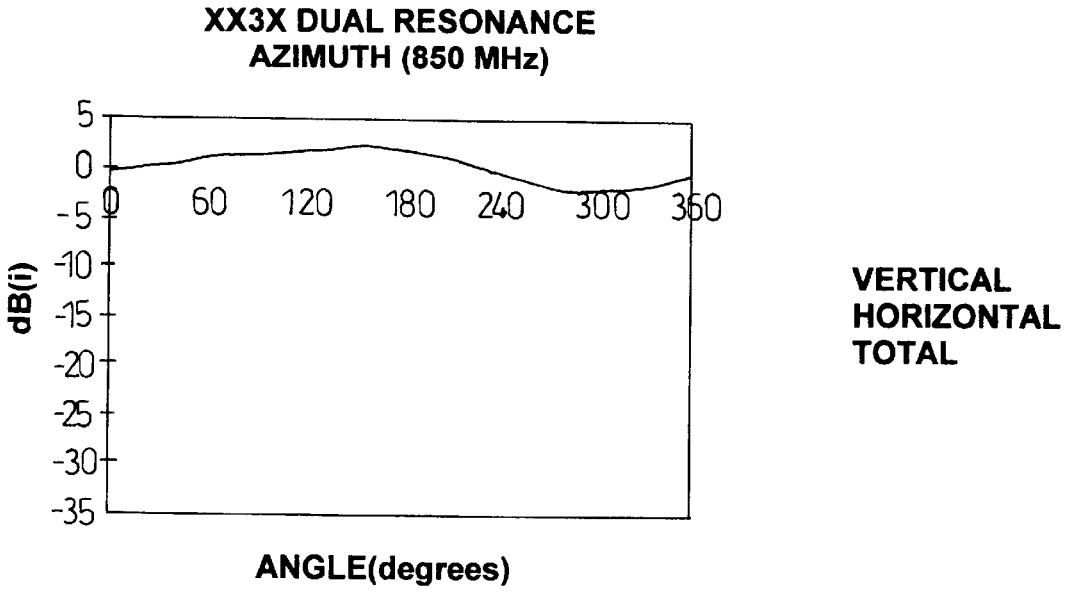
FIG. 8 shows the azimuth radiation pattern for the dual band antenna.
Figure 8:
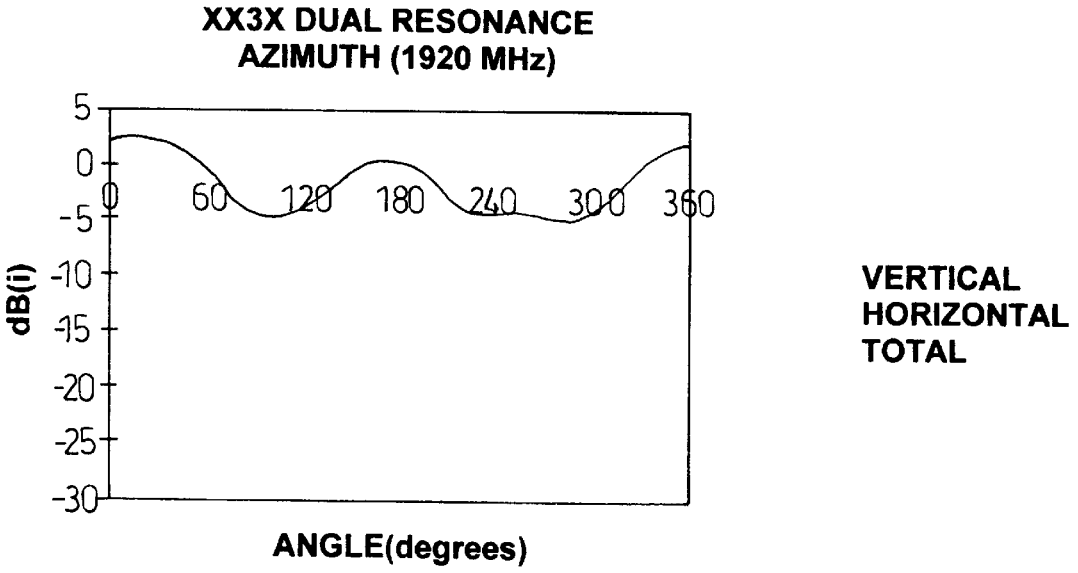

FIGS. 6, 7 and 8 show respectively the insertion loss of the dual band antenna; the azimuth radiation pattern of the single band antenna; the azimuth radiation pattern of the dual band antenna at 850 MHz; and at 1920 MHz.

Figure 9:
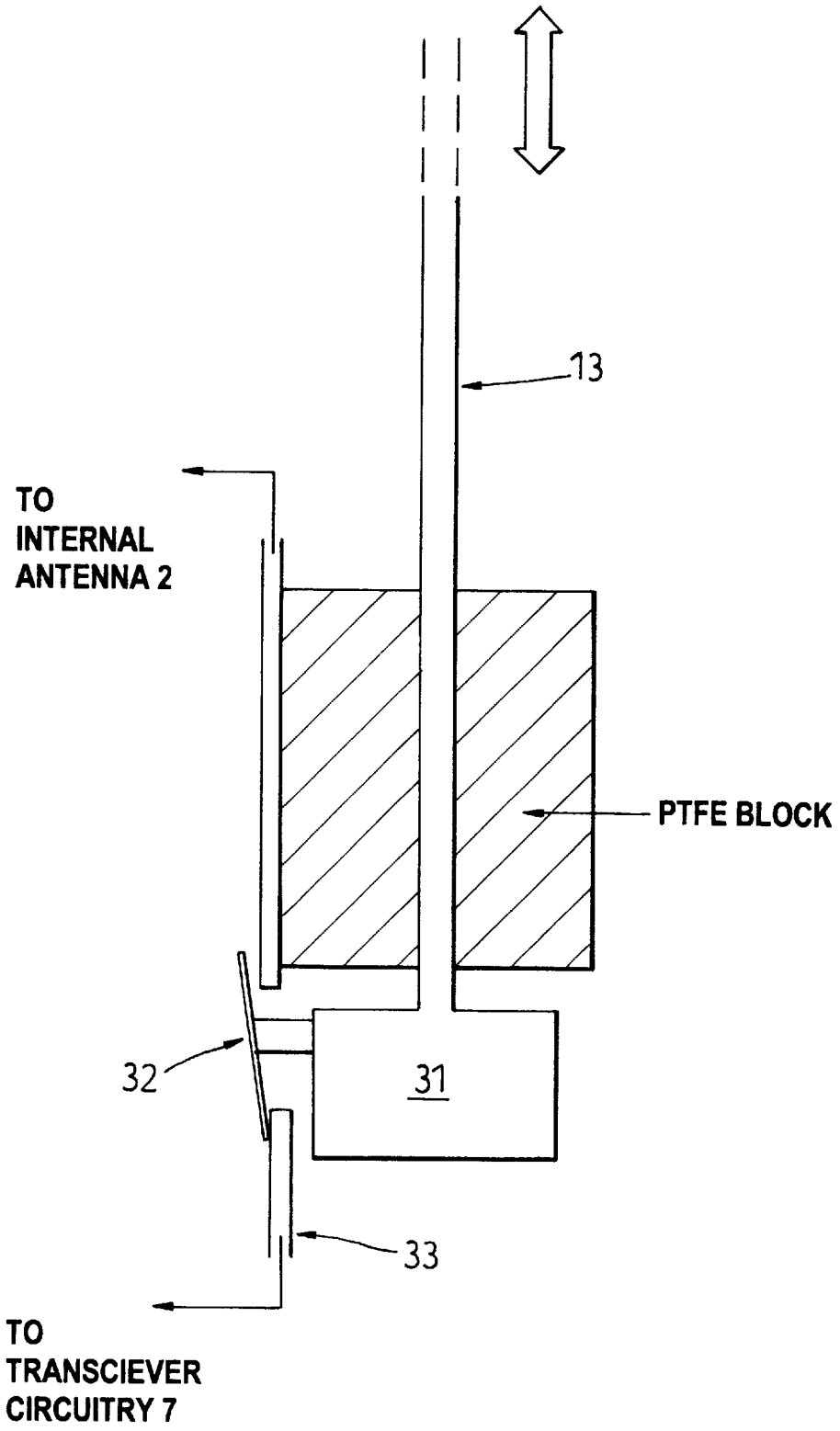
FIG. 9 shows an external antenna switching arrangement.

Referring now to FIGS. 1 and 9 and a further inventive aspect in which a switching arrangement is used to switch between the internal antenna 2 and an external antenna 13 such as a telescopically extendible monopole. This allows each antenna to be individually optimised without the detrimental influence of the other antenna being in circuit. The need for complex and expensive dual matching circuitry is therefore essentially eliminated. The use of the switching arrangement is not restricted to the particular antenna arrangement of the invention as described above, but could be used with any type of internal and external antenna.

The switching arrangement is shown in more detail in FIG. 9 and makes use of the manual engagement or disengagement of the external antenna 13. As the external antenna 13 is pulled out a metallic contact 31 attached at its base engages a flat spring contact 32 which disconnects the internal antenna 2 from the transceiver output 33, and simultaneously connects the external antenna 13 to the transceiver output 33. The reverse occurs when the external antenna 13 is manually pushed back into the handset.

The switching arrangement could also be modified to operate using external antennas which are folded out or which are physically connected to the handset when required. Various alternative switching arrangements are conceivable by a person skilled in the art, including electronic switching, capacitive coupling, and other mechanical switching means.

What is claimed is:

1. A radio communications handset comprising a speaker having an adjacent acoustic enhancing volume of free space, wherein said handset is arranged such that said speaker projects sound in a foward direction and said volume is located adjacent said speaker in a backward direction in order to provide acoustic enhancements; and an antenna arrangement comprising a ground plane and a radiating element which are located arid arranged to include the acoustic volume therebetween.

2. The radio communications handset according to claim 1 wherein the radiating element is spaced a non-uniform distance from said ground plane.

3. The radio communications handset according to claim 1 wherein the antenna arrangement comprises a ground plane;

a meandering radiating element extending in a series of opposing bends from a radio-frequency feed point and spaced a non-uniform distance from said ground plane;

and wherein said volume is located between said ground plane and said radiating element.

4. The radio communications handset according to claim 3 wherein the antenna arrangement further comprises a planar element connected to the free end of said radiating element and extending back along and substantially parallel with said radiating element.

5. The radio communications handset according to claim 3 wherein said opposing bends are effected in more than one plane.

6. The radio communications handset according to claim 1 wherein the handset further comprises:

an extendible external antenna;

radio frequency transceiver means; and antenna switching means which is arranged to switch between said transceiver means and said external antenna or said antenna arrangement upon manual extension or retraction of said external antenna.

7. A radio communications handset comprising an internal antenna arrangement adapted to accommodate one or more handset elements, said internal antenna arrangement comprising:

a ground plane;

a meandering radiating element extending in a series of opposing bends from a radio-frequency feed point and spaced a non-uniform distance from said ground plane;

wherein said handset elements are located between said radiating element and said ground plane.

8. The radio communications handset according to claim 7 wherein said handset elements comprise an acoustic enhancing volume of free space adjacent a loudspeaker.

9. A radio communications handset internal antenna arrangement comprising:

a ground plane;

a meandering radiating element extending in a series of opposing bends from an radio-frequency feed point and spaced a non-uniform distance from said ground plane.

10. The radio communications handset internal antenna arrangement according to claim 9 wherein said non-uniform spacing is such that the radiating element extends in an arc across the ground plane.

11. A radio communications handset internal antenna arrangement comprising:

a groundplane;

a meandering radiating element extending in a series of opposing bends from a radio frequency feed point and spaces a non-uniform distance from said ground plane; and a planar element connected to the free end of said radiating element and extending back along and substantially parallel with said radiating element.

12. The radio communications handset internal antenna arrangement according to claim 11 wherein said non-uniform spacing is such that the radiating element extends in an arc across the ground plane.

* * * * *

UNITED STATES PATENT AND TRADEMARK OFFICE

CERTIFICATE OF CORRECTION

PATENT NO. : 6,304,222 B1
DATED : October 16, 2001
INVENTOR(S) : Smith et al.

It is certified that error appears in the above-identified patent and that said Letters Patent is hereby corrected as shown below:

Column 6,
Line 48, "arid" should be -- and --.

Signed and Sealed this

Sixth Day of August, 2002

*Attest:*

*Attesting Officer*

JAMES E. ROGAN
*Director of the United States Patent and Trademark Office*